US007252562B1

(12) United States Patent
Chen

(10) Patent No.: US 7,252,562 B1
(45) Date of Patent: Aug. 7, 2007

(54) ELECTRICAL FEMALE TERMINAL AND FEMALE ELECTRICAL CONNECTOR

(75) Inventor: Ping Chen, Farmington Hills, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/502,425

(22) Filed: Aug. 11, 2006

(51) Int. Cl.
*H01R 13/11* (2006.01)

(52) U.S. Cl. ..... 439/852

(58) Field of Classification Search ..... 439/852, 439/752.5, 595, 850
See application file for complete search history.

(56) References Cited

U.S. PATENT DOCUMENTS 4,963,102 A * 10/1990 Gettig et al. ..... 439/291
5,281,175 A * 1/1994 Chupak et al. ..... 439/839
6,755,697 B2 * 6/2004 Kojima et al. ..... 439/852

* cited by examiner

*Primary Examiner*—Phuong Dinh
(74) *Attorney, Agent, or Firm*—Rader, Fishman & Grauer PLLC

(57) ABSTRACT

An electrical female terminal has a female terminal body that extends along a central axis and includes a terminal receptacle and a clamping member integrally connected thereto. The terminal receptacle forms a box-shaped configuration to define a generally box-shaped cavity extending through the terminal receptacle. A spring element is disposed within the box-shaped cavity and is connected adjacent a top wall and a rearward end of the terminal receptacle and projects toward a bottom wall and a forward end of the terminal receptacle. The top wall includes a cutout window that is positioned offset from the central axis. An electrical female terminal connector includes a female connector housing and the female terminal.

12 Claims, 8 Drawing Sheets

ELECTRICAL FEMALE TERMINAL AND FEMALE ELECTRICAL CONNECTOR

FIELD OF THE INVENTION

The present invention is related to a female electrical connector. More specifically, the present invention is directed to an electrical female terminal and a female connector housing that receives the electrical female terminal to form the female electrical connector.

BACKGROUND OF THE INVENTION

As commonly known in the art, to construct a female electrical connector, an electrical female terminal or a plurality of electrical female terminals (hereinafter referred to as "female terminal" or "female terminals") are inserted into a plastic female connector housing. The female terminal has a spring element to maintain proper contact, and a box protecting the spring from over-deformation. The female terminals in the connector housing are securely retained therein by a separate plastic part, commonly referred to as a TPA. In the industry, TPA means terminal position assurance. Also, a primary lock in addition to the TPA might also be used to further securely retain the female terminal or female terminals in the plastic female connector housing.

Generally, there are two different types of TPA's currently being used in the industry today. One is a front-type TPA and the other is a side-type TPA. For the front-type TPA, a lance mounted within the female connector housing in a terminal insertion direction engages a back portion of the female terminal while the front-type TPA is inserted into the female connector housing from the front of the female connector housing. In other words, the lance and the front-type TPA extend parallel to the terminal insertion direction. The lance acts as a primary lock while the front-type TPA acts as a secondary lock to prevent the lance from deflecting.

The side-type TPA is inserted into the female connector housing from a side perpendicular to the terminal insertion direction. The lance engages with the female terminal at approximately the middle of its terminal box and the side-type TPA engages the back portion of the female terminal. The lance acts as the primary lock and the side-type TPA acts as the secondary lock.

As a result of having a front-type TPA and a side-type TPA, different designs of the female terminals are required to accommodate each TPA type. Having two different TPA types and thus having two different types of female terminal increases manufacturing cost Also, a conventional female terminal has an orientation feature to prevent the female terminal from being inserted into the female connector housing in a wrong orientation. Such orientation feature is usually a protrusion over a wall of the terminal box of the female terminal. In manufacturing, often a corner of the terminal box of the female terminal is cut off. However, when a water-proof female terminal is required, the female terminal is inserted into a rubber seal. This style of the orientation feature might concentrate a strain on the rubber seal.

It would be beneficial to provide a female terminal of a single design that can accommodate both a female connector housing employing the front-type TPA design and a female connector housing employing the side-type TPA design. Also, it would be advantageous to provide a female terminal with an orientation feature that would not concentrate a strain on a water-proofing rubber seal.

OBJECTS AND SUMMARY OF THE INVENTION

It is an object of the present invention to provide a female terminal of a single design that can accommodate both a female connector housing employing the front-type TPA design and a female connector housing employing the side-type TPA design.

It is a further object of the present invention to provide a female terminal with an orientation feature that would not concentrate a strain on a water-proof rubber seal.

One exemplary embodiment of the present invention is directed to an electrical female terminal that includes a female terminal body. The female terminal body extends along a central axis and includes a terminal receptacle having a forward end and an opposing rearward end and a clamping member. The clamping member is integrally connected to the terminal receptacle at the rearward end thereof. The terminal receptacle has a bottom wall, a top wall, a pair of side walls and a spring element. The top wall is disposed apart from and extends parallel to the bottom wall and the pair of side walls is disposed apart from and extends parallel to one another and is connected to the bottom wall and the top wall to form a box-shaped configuration defining a generally a box-shaped cavity. The box-shaped cavity extends through the terminal receptacle between a forward opening located at the forward end and a rearward opening located at the rearward end. The spring element is disposed within the box-shaped cavity and is connected adjacent the top wall and rearward end and projects toward the bottom wall and the forward end. The top wall includes a cutout window that is positioned offset from the central axis.

Another exemplary embodiment of the present invention is directed to an electrical female terminal that includes a female terminal body. The female terminal body extends along a central axis and includes a terminal receptacle having a forward end and an opposing rearward end and a clamping member. The clamping member is integrally connected to the terminal receptacle at the rearward end thereof. The terminal receptacle has a bottom wall, a top wall, a pair of side walls and a spring element. The top wall is disposed apart from and extends parallel to the bottom wall and the pair of side walls is disposed apart from and extends parallel to one another and is connected to the bottom wall and the top wall to form a box-shaped configuration defining a generally a box-shaped cavity. The box-shaped cavity extends through the terminal receptacle between a forward opening located at the forward end and a rearward opening located at the rearward end. The spring element is disposed within the box-shaped cavity and is connected adjacent the top wall and rearward end and projects toward the bottom wall and the forward end. The bottom wall includes a flat wing projection that projects laterally from the bottom wall.

Yet another exemplary embodiment of the present invention is directed to an electrical female terminal connector that includes a connector housing and a female terminal body as described above. The connector housing has at least one female terminal body channel extending longitudinally along a central axis and formed though the connector housing. A resiliently-biased lance is connected internally of the connector housing at a connected lance end and having a latch formed at a free lance end projecting into the at least one female terminal body. The top wall includes a cutout window that is positioned offset from the central axis with the latch also being positioned offset from the central axis such that when the female terminal body is inserted into the at least one female terminal channel that latch seats in the cutout window.

These objects and other advantages of the present invention will be better appreciated in view of the detailed description of the exemplary embodiments of the present invention with reference to the accompanying drawings, in which:

BRIEF DESCRIPTION OF THE DRAWING FIGURES

DETAILED DESCRIPTION OF THE EXEMPLARY EMBODIMENTS

The detailed description of the exemplary embodiments of the present invention is hereinafter described. However, a skilled artisan will appreciate that terms such as "top" and "bottom" used herein are for the purpose of simplifying the explanation of the exemplary embodiments of the present invention for ease of understanding. Such terms are not intended to orient the exemplary embodiments of the present invention in three-dimensional space.

Figure 1:
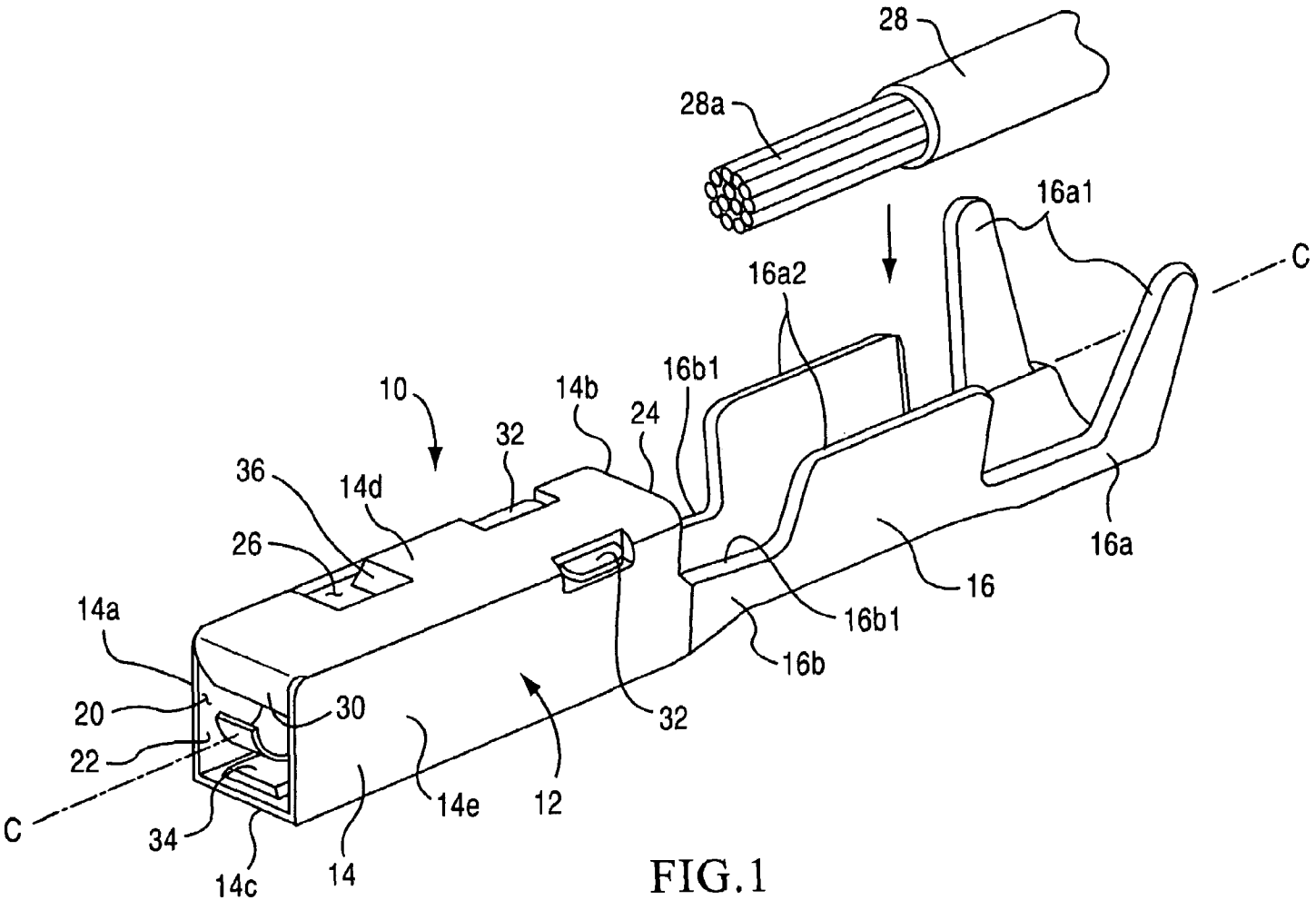
FIG. 1 is a perspective view of an exemplary embodiment of a female terminal of the present invention.
Figure 2:
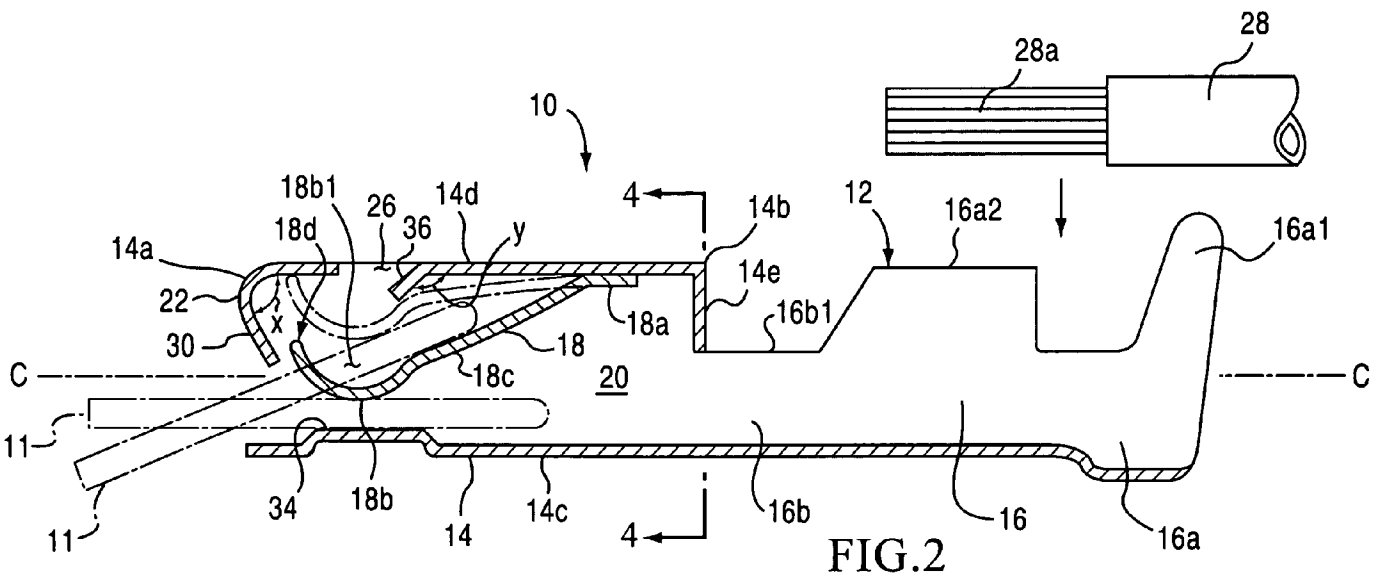
FIG. 2 is a cross-sectional side elevation of view of the female terminal illustrated in FIG. 1.
Figure 3:
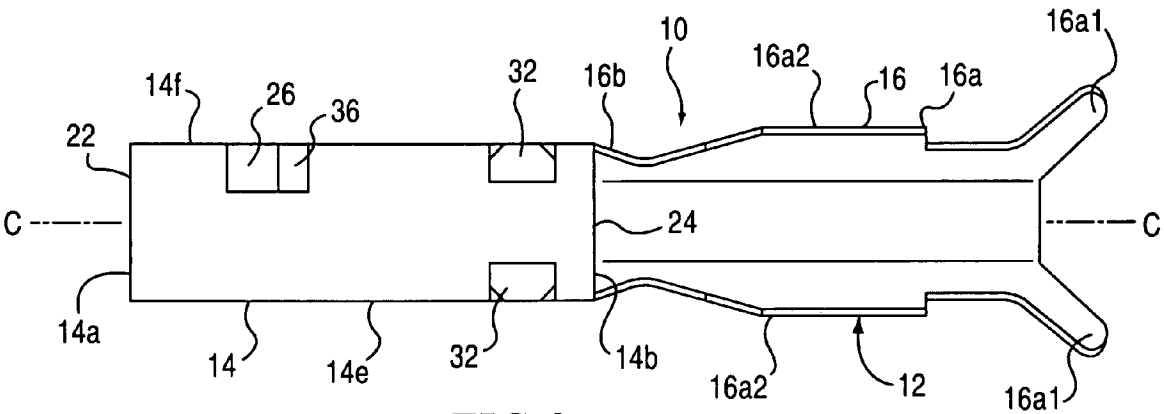
FIG. 3 is a top plan view of the female terminal illustrated in FIG. 1.

As shown in FIGS. 1-4, one exemplary embodiment of the present invention is an electrical female terminal 10 (hereinafter referred to as "female terminal 10"). The female terminal 10 has a female terminal body 12 that extends along a central axis C. The female terminal body 12 includes a terminal receptacle 14 and a clamping member 16. The terminal receptacle 14 has a forward end 14*a* and an opposing rearward end 14*b*. The clamping member 16 is integrally connected to the terminal receptacle 14 at the rearward end 14*b* thereof. The terminal receptacle 14 has a bottom wall 14*c*, a top wall 14*d*, a pair of side walls 14*e*, 14*f* and a spring element 18. The top wall 14*d* is disposed apart from and extends parallel to the bottom wall 14*c*. The pair of side walls 14*e*, 14*f* are disposed apart from and extend parallel to one another and are connected to the bottom wall 14*c* and the top wall 14*d* to form a box-shaped configuration (FIGS. 1 and 4) defining a generally box-shaped cavity 20. As best shown in FIG. 2, the box-shaped cavity 20 extends through the terminal receptacle 14 between a forward opening 22 located at the forward end 14*a* and a rearward opening 24 located at the rearward end 14*b*. The spring element 18 is disposed within the box-shaped cavity 20 and is connected adjacent the top wall 14*d* and rearward end 14*b* and projects toward the bottom wall 14*c* and the forward end 14*a* as best shown in FIG. 2. With reference to FIGS. 1 and 3, the top wall 14*d* includes a cutout window 26 that is positioned offset from the central axis.

In FIGS. 1-3, the clamping member 16 includes a wire-receiving channel member 16*a* and a neck member 16*b*. The wire-receiving channel member 16*a* has a pair of wire-insulation clamping tabs 16*a*1 and a pair of wire-clamping tabs 16*a*2 projecting therefrom. The neck member 16*b* is integrally connected to the wire-receiving channel member 16*a*. The pair of wire-clamping tabs 16*a*2 are positioned between the wire-insulation clamping tabs 16*a*1 and the neck member 16*b*. As best shown in FIGS. 1-4, the neck member 16*b* is integrally connected to the rearward end 14*b* of the terminal receptacle 14. As is commonly known in the art, a conventional insulated wire 28 having a stripped end 28*a* is placed in the clamping member 16. The pair of wire-insulation clamping tabs 16*a*1 and the pair of wire-clamping tabs 16*a*2 are crimped by a conventional crimping tool (not shown) resulting in the insulated wire 28 being clamped to the female terminal body 12 as shown in FIG. 5.

Figure 4:
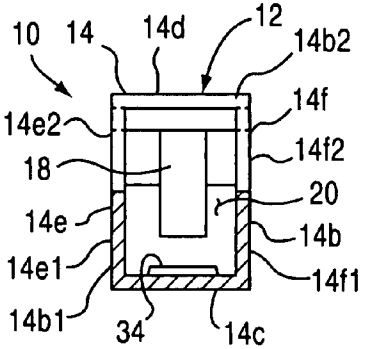
FIG. 4 is a partial cross-sectional view taken along line 4-4 in FIG. 2.
Figure 5:
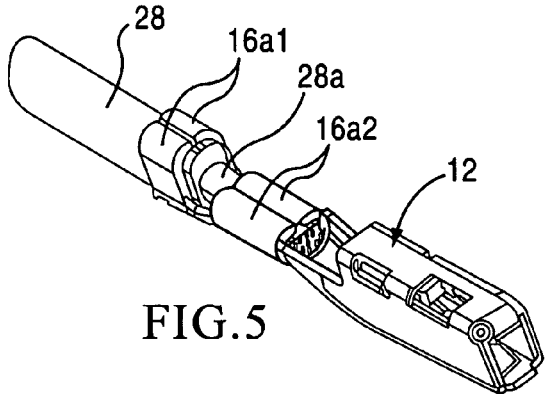
FIG. 5 is a perspective view of the female terminal in FIG. 1 with a conventional wire crimped thereto.

With reference to FIG. 4, the rearward end 14*b* of the terminal receptacle 14 has a bottom rearward end portion 14*b*1 and a top rearward end portion 14*b*2. The bottom rearward end portion 14*b*1 includes the bottom wall 14*c* and bottom side wall portions 14*e*1, 14*f*1 of each respective one of the pair of side walls 14*e*, 14*f*. The top rearward end portion 14*b*2 includes the top wall 14*d* and top side wall portions 14*e*2, 14*f*2 of each respective one of the pair of side walls 14*e*, 14*f*. A skilled artisan would appreciate that the neck member 16*b* is integrally connected to the rearward end 14*b* of the terminal receptacle 14 at the bottom rearward end portion 14*b*1 and the top rearward end portion 14*b*2 defines a stay.

As shown in FIGS. 1 and 2, the neck member 16*b* includes a pair of top neck member edges 16*b*1. As best shown in FIG. 2, a respective one of the top neck member edges 16*b*1 extends substantially perpendicularly to a respective one of the pair of side walls 14*e*, 14*f* as viewed in elevation along the central axis. In other words, respective ones of the top neck member edges 16*b*1 perpendicularly intersect respective ones of the side walls 14*e* and 14*f*.

With reference to FIGS. 1 and 2, the terminal receptacle 14 also includes an insertion guide wall 30. The insertion guide wall 30 is connected to the top wall 14*d* at the forward end 14*a* of the terminal receptacle 14 and extends into the box-shaped cavity 20 at an insertion guide wall angle x towards the bottom wall 14*c* and the rearward end 14*b* of the terminal receptacle 14. The insertion guide wall is positioned forward of the spring element 18 as shown FIG. 2.

In FIGS. 1 and 3, each one of the pair of side walls 14*e*, 14*f* has a spring engagement slot 32 adjacent the top wall 14*d*. The spring engagement slots 32 are facially opposed to one another. In FIG. 2, the spring element 18 is fabricated from a resiliently-bias, electrically-conductive material such metal and includes an engagement portion 18*a*, a contact portion 18*b* and a straight portion 18*c* integrally interconnecting the engagement portion 18*a* and the contact portion 18*b*. The engagement portion 18*a* is in contact with the top wall 14*d* inside the box-shaped cavity 20 and extends into the spring engagement slots 32 in order to retain the spring element 18 securely within the box-shaped cavity 20. The contact portion 18*b* is configured in an arcuate shape to define a recess 18*b*1 as viewed in cross-section in FIG. 2. Note that the recess 18*b*1 is facially opposed to the cutout window 26.

In FIG. 2, a phantomly-drawn male terminal 11 when extending parallel to the central axis C is properly positioned within the female terminal body 12. When positioned at an angle within the female terminal body 12, overstress of the spring element 18 might result. A tip end 18*d* of the spring element 18 acts as an overstress protector of the spring element 18 when the spring might be overstressed by the phantomly-drawn male terminal 11 positioned at an angle. The tip end 18*d* of the spring element 18 helps to relieve overstress of the spring element 18 when the tip end 18*d* contacts the top wall 14 internally with the box-shaped cavity 20 as drawn in phantom in FIG. 2.

By way of example only and not by way of limitation, the female terminal 10 also includes a plateau 34 as illustrated in FIGS. 1, 2 and 4. The plateau projects from the bottom wall 14*c* internally of the box-shaped cavity 20. Note that the plateau 34 is positioned generally opposite the contact portion 18*b* of the spring element 18. Also, by way of example only and not by way of limitation, the female terminal 10 might also include an inclined piece 36 as illustrated in FIGS. 1-3. The inclined piece 36 is connected to the top wall 14*d* and projects into the cutout window 26 at an obtuse angle y (FIG. 2) relative to the top wall 14*d* generally from the rearward end 14*b* to the forward end 14*a*. As mentioned above, it is possible for a male terminal 11 to overstress the spring element 18 as shown in FIG. 2. The incline piece 36 can help relieve the overstress when the spring element 18 contacts the inclined piece 36 as shown in phantom in FIG. 2.

Figure 6:
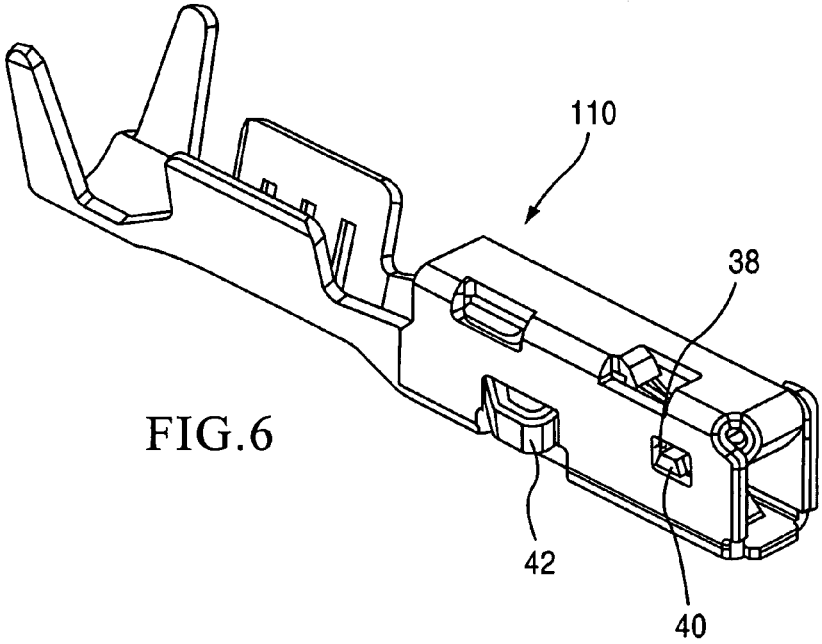
FIG. 6 is a perspective view of another exemplary embodiment of a female terminal of the present invention.
Figure 7:
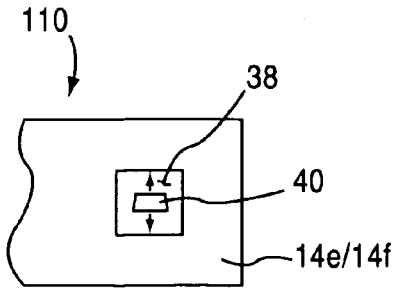
FIG. 7 is a partial elevation of view of the female terminal in FIG. 6.
Figure 8:
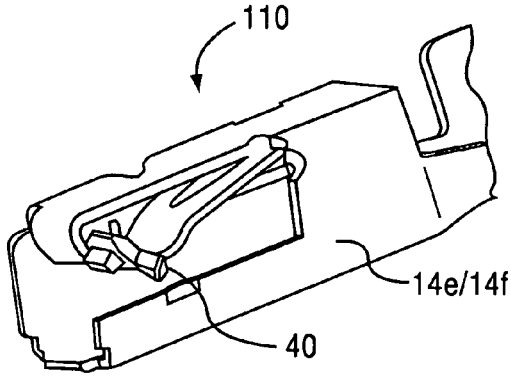
FIG. 8 is a partial perspective view partially broken away on the female terminal in FIG. 6.

Another exemplary embodiment of a female terminal 110 of the present invention is illustrated in FIGS. 6-8. The female terminal 110 is substantially identical to the female terminal 10 described above except that the female terminal 110 includes an opposing pair of movement restraint windows 38 formed though respective ones of the pair of side walls 14*e* and 14*f*, a pair of opposing movement restraint tabs 40 integrally connected to the contact portion 18*b* of the spring element 18 and an orientation projection 42. Respective ones of the movement restraint tabs 40 sized to be received by respective ones of the movement restraint windows 38. It is appreciated by a skilled artisan that the movement restraint windows 38 permit yet restrict movement of the movement restraint tabs 40 as best shown by the arrows in FIG. 7. However, one of ordinary skill in the art would appreciate that it is not necessary to have a pair of movement restraint windows 38 and a pair of movement restraint tabs 40. As a result, the female terminal 110 would include at least one movement restraint window 38 and at least one movement restraint tab 40 received therein. Therefore, at least one of the pair of side walls 14*e* or 14*f* would include one movement restraint window 38 and one movement restraint tab 40 received therein formed through the one side wall 14*e* or 14*f*. Further, a skilled artisan would appreciate that the orientation projection that projects from one of the pair of side walls 14*e* or 14*f* is a visual indicator to a user how to properly orientate the female terminal 110 before inserting it into a female terminal housing as discussed below.

Figure 9:
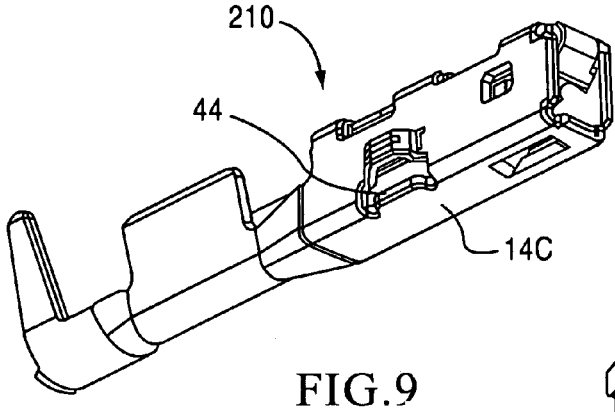
FIG. 9 is a perspective view of yet another exemplary embodiment of a female terminal of the present invention.
Figure 10:
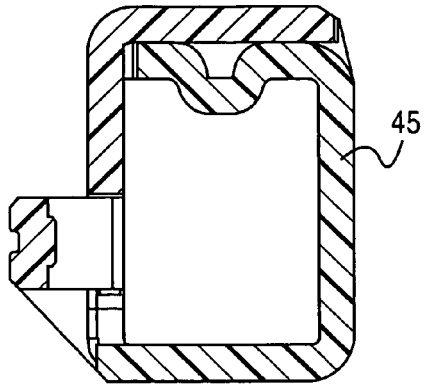
FIG. 10 is in elevation of view of a rubber seal that receives the female terminal illustrated in FIG. 9.

Yet another exemplary embodiment of a female terminal 210 of the present invention is illustrated in FIGS. 9-10. The female terminal 210 is substantially identical to the female terminal 110 described above except that the female terminal 210 includes a flat wing projection 44. The flat wing projection 44 projects laterally from the bottom wall 14*c*. The flat wing projection 44 is particularly suited when the female terminal 210 in inserted into a rubber seal 45 shown in FIG. 10. As known in the art, the rubber seal 45 is used with a female connector to provide sealed, i.e. "waterproof", female connectors. The flat wing projection 44 releases strain concentration when the female terminal 210 is inserted into the rubber seal 45.

Figure 11:
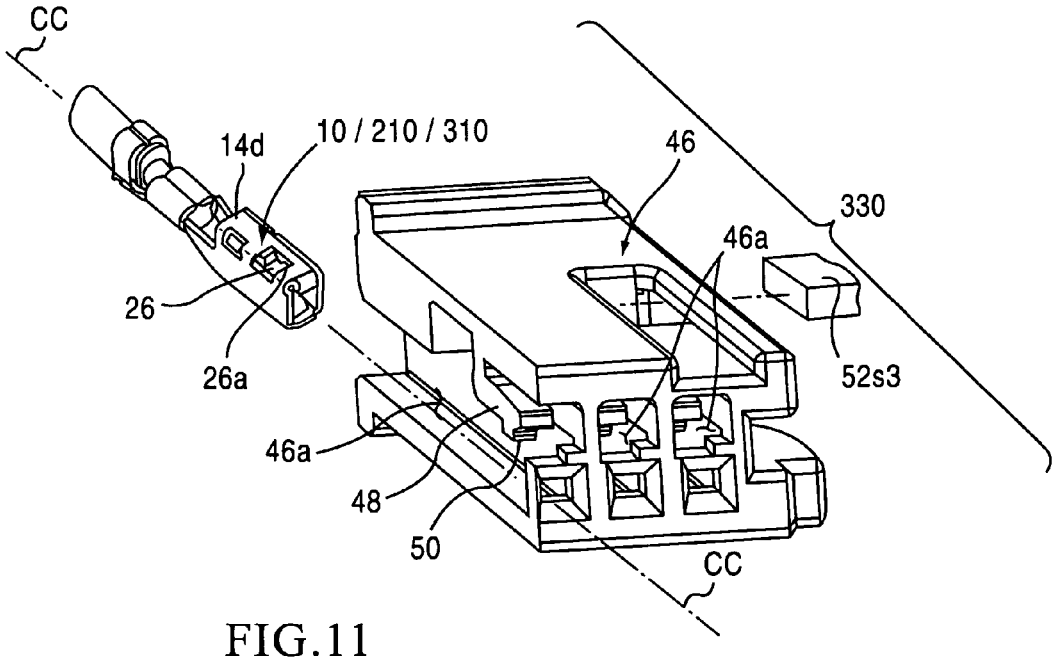
FIG. 11 is a perspective view of another exemplary embodiment of a female terminal connector of the present invention.
Figure 12:
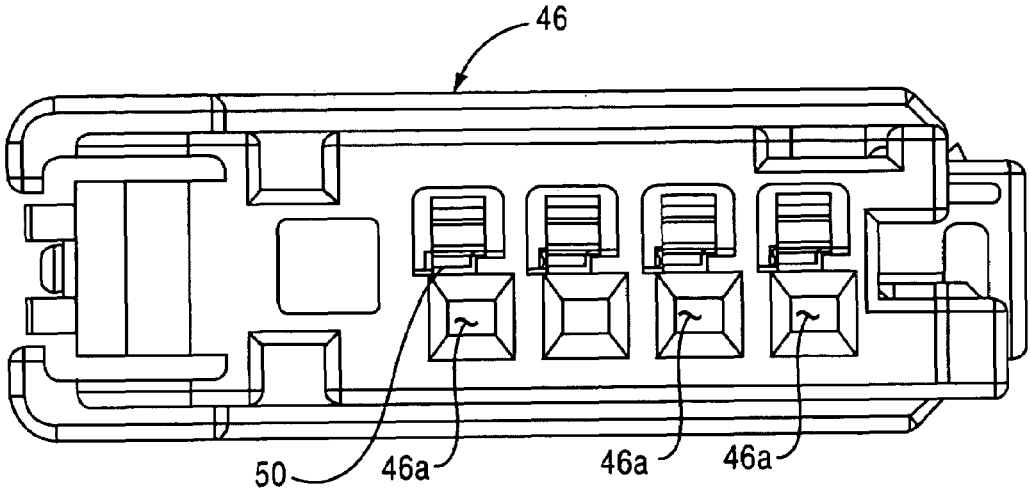
FIG. 12 is a front elevation of view of a female connector housing.

Still yet another embodiment of the present invention is an electrical female terminal connector 330 (hereinafter "female terminal connector 330") as shown in FIGS. 11 and 12. The female terminal connector 330 includes at least one female terminal such as female terminal 10, 210 or 310 described above and a female connector housing 46 having a plurality of female terminal body channels 46 as extending generally longitudinally along a connector central axis and a plurality of resiliently-biased lances 48. Each one of the plurality of female terminal body channels 46*a* extending longitudinally along a connector central axis CC. Each one of the resiliently-biased lances 48 is connected internally of the female connector housing 46 at a connected lance end. Each one of the resiliently-biased lance 48 has a latch 50 formed at a free lance end thereof. As shown in FIG. 11, a respective one of the resiliently-biased lances 48 projects into a respective one of the female terminal body channels 46*a*. Note that a secondary lock 52*s*3 can be inserted into the female connector housing 46 from a sideways direction to lock the female terminal 10, 210 or 310 therein.

In FIG. 11, the top wall 14*d* includes the cutout window 26 that is positioned offset from the connector central axis CC with the latch 50 also being positioned offset from the connector central axis such that when the female terminal is inserted into a selected one of the female terminal body channels 46*a* the latch 50 seats in the cutout window 26 as discussed below.

Furthermore, a skilled artisan would appreciate that the female connector housing 46 might include only one female terminal body channel 46*a* and only one resiliently-biased lance 48. Thus, the female connector housing 46 includes at least one female terminal body channel 46 and at least one resiliently-biased lance projecting thereinto.

Figure 13:
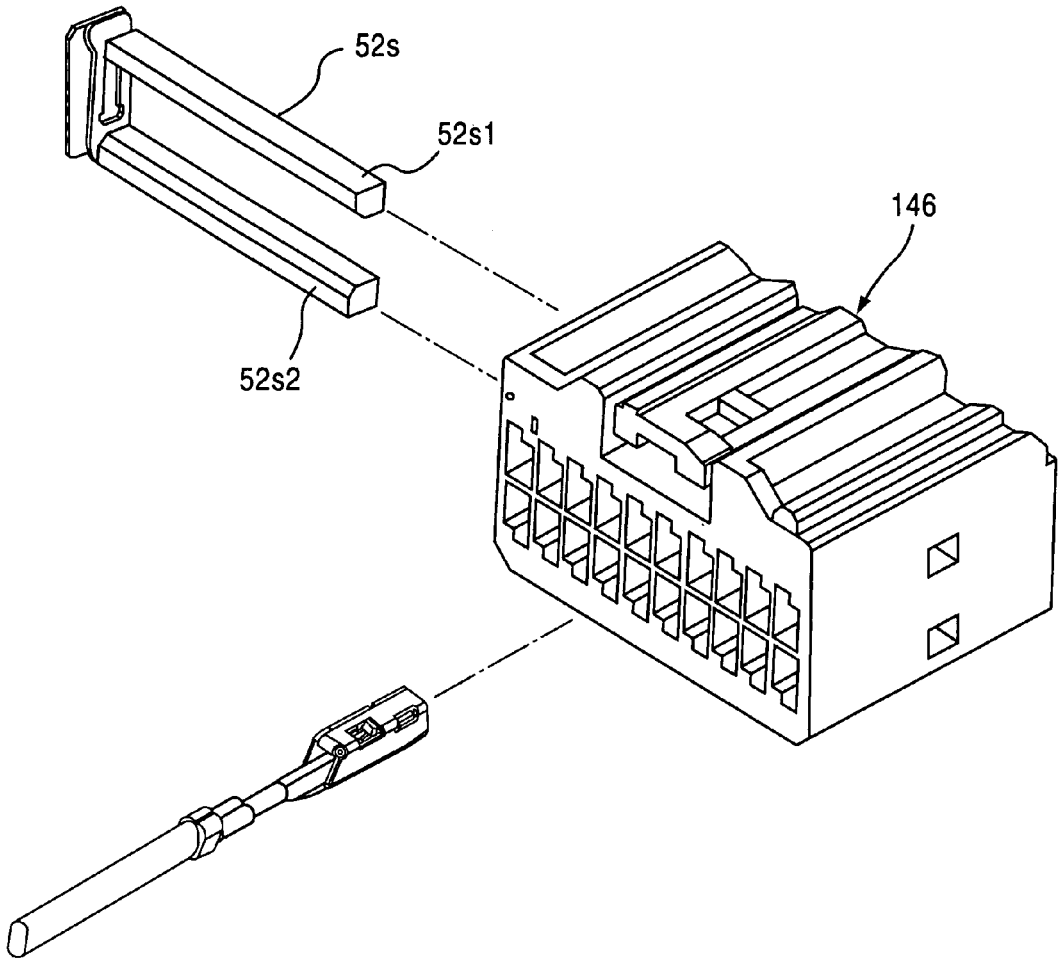
FIG. 13 is a perspective view of a female connector housing, a female terminal and a side-type TPA.
Figure 14:
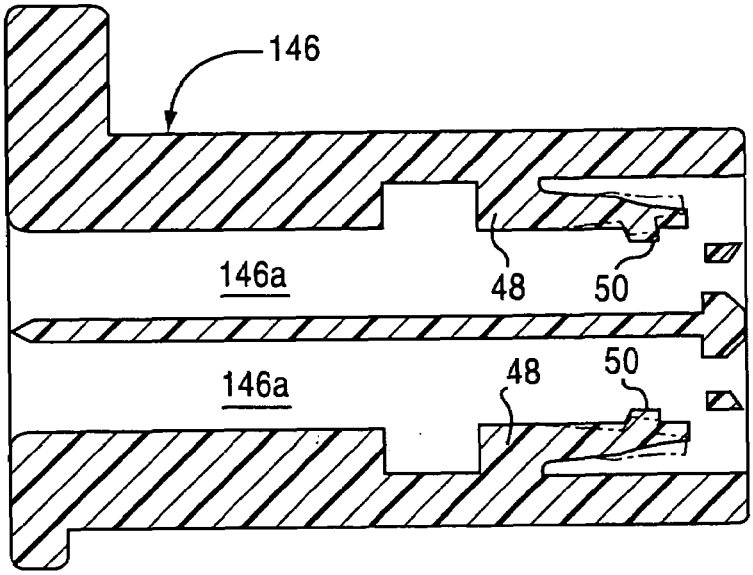
FIG. 14 is a side elevation view in cross-section of a female connector housing for use with a side-type TPA.
Figure 15:
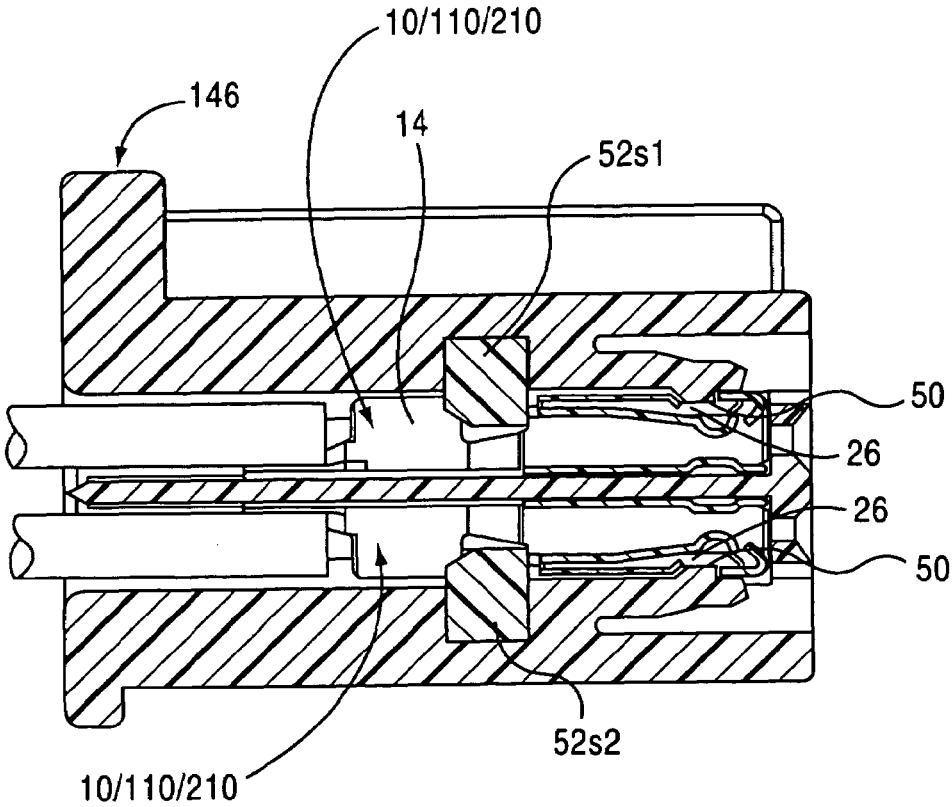
FIG. 15 is a side elevation view in cross-section of the female connector housing in FIG. 14 with two female terminals inserted therein.

FIGS. 13-15 illustrate a female connector housing 146 having two rows of female terminal body channels 146*a* that incorporates a side-type TPA 52*s* having a pair of elongated stops 52*s*1 and 52*s*2. FIG. 14 shows two resiliently-biased lances 48, one in each row, in a normally seated position and in a resiliently-biased position as drawn in phantom. In FIG. 15, respective ones of the latches 50 are seated in respective ones of the cutout windows 26. The side-type TPA52*s* is inserted into the female connector housing 146 such that respective ones of the elongated stops 52*s*1 and 52*s*2 engage with the stay (i.e., the top side wall portions 14*e*2 and 14*f*2 and the top rearward end portion 14*b*2 of the terminal receptacle 14 as best shown in FIG. 4) of the terminal receptacle 14. Although not by way of limitation but by way of example only, note that the female terminals 10 or 10 or 210 are positioned upside down from one another.

Figure 16:
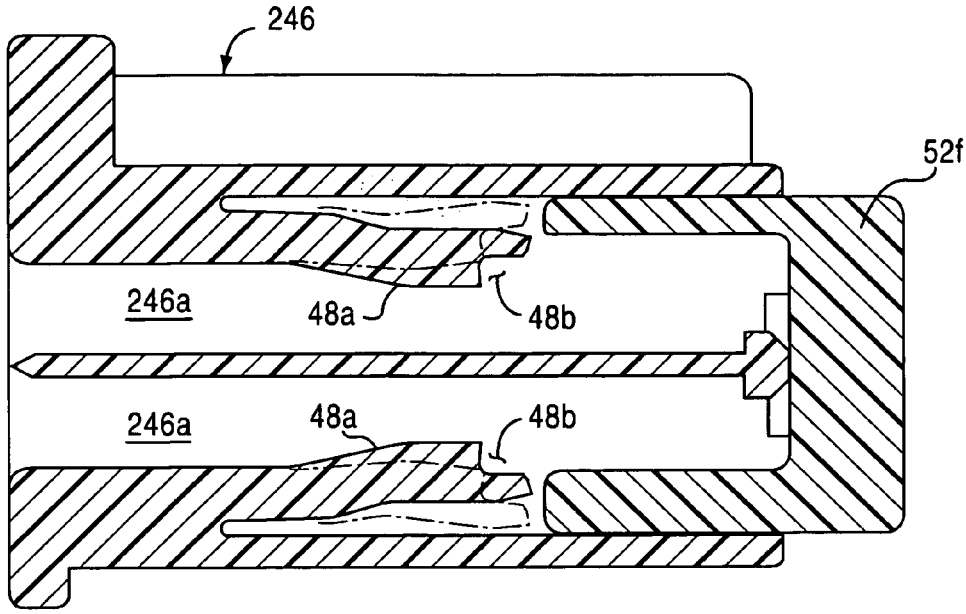
FIG. 16 is a side elevation view in cross-section of a modified female connector housing for use with a front-type TPA.
Figure 17:
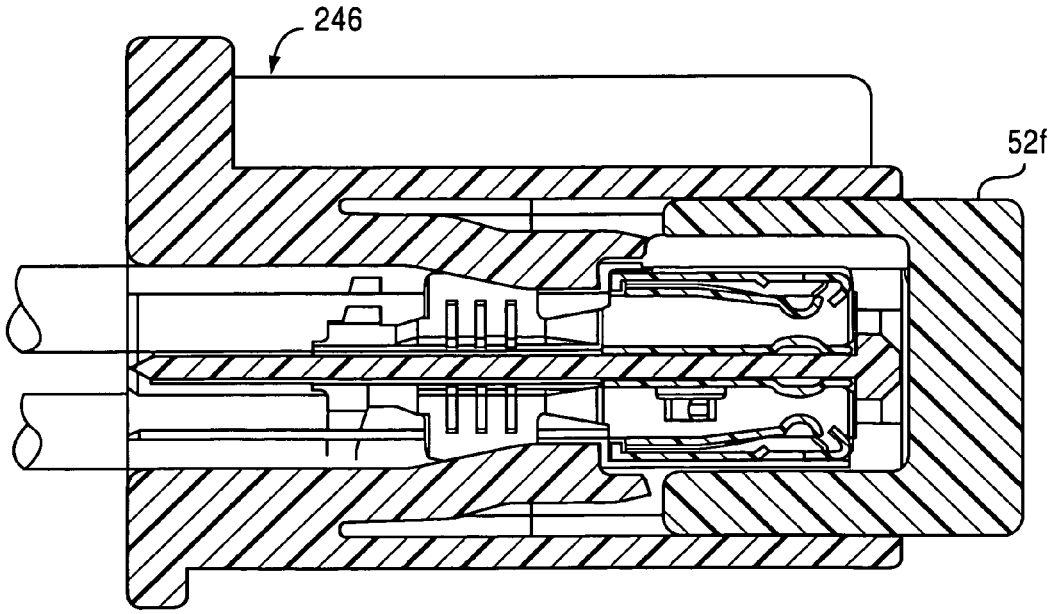
FIG. 17 is a side elevation view in cross-section of the modified female connector housing in FIG. 16 with two female terminals inserted therein.

FIGS. 16 and 17 illustrate a female connector 246 having two rows of female terminal body channels 246*a* that incorporates a front-type TPA 52*f* that is formed in cross-section as a U-shaped configuration. FIG. 16 shows the resiliently-biased lances 48*a* in a normally seated position and in a resiliently-biased position as drawn in phantom. In FIG. 17, the front-type TPA52*f* is inserted into the female connector housing 146 to facially oppose the resiliently-biased lances 48*a*. Note that each one of the resiliently-biased lances 48*a* form an engagement notch 48*b* such that respective ones of the resiliently-biased lances 48*a* engage with the stay (i.e., the top side wall portions 14*e*2 and 14*f*2 and the top rearward end portion 14*b*2 as best shown in FIG. 4) and a rearward portion of the top wall 14*d* of the terminal receptacle 14.

In view of the above, the present invention provides a female terminal of a single design that can accommodate both a female connector housing employing the front-type TPA design and a female connector housing employing the side-type TPA design. Also, the present invention provides a female terminal with a feature that would not concentrate a strain on a water-proof rubber seal.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An electrical female terminal, comprising:

a female terminal body extending along a central axis and including a terminal receptacle having a forward end and an opposing rearward end and a clamping member integrally connected to the terminal receptacle at the rearward end thereof, the terminal receptacle having a bottom wall, a top wall, a pair of side walls and a spring element, the top wall disposed apart from and extending parallel to the bottom wall and the pair of side walls disposed apart from and extending parallel to one another and connected to the bottom wall and the top wall to form a box-shaped configuration defining a generally box-shaped cavity extending through the terminal receptacle between a forward opening located at the forward end and a rearward opening located at the rearward end, the spring element disposed within the box-shaped cavity and connected adjacent the top wall and rearward end and projecting toward the bottom wall and the forward end, wherein the top wall includes a cutout window that is positioned offset from the central axis, wherein each one of the pair of side walls has a spring engagement slot adjacent the top wall with the spring engagement slots being facially opposed to one another, and wherein the spring element is fabricated from a resiliently-bias, electrically-conductive material and includes an engagement portion, a contact portion and a straight portion integrally interconnecting the engagement portion and the contact portion, the engagement portion being in contact with the top wall inside the box-shaped cavity and extending into the spring engagement slots to retain the spring element within the box-shaped cavity, the contact portion configured in an arcuate shape to define a recess as viewed in cross-section with the recess being facially opposed to the cutout window.

2. An electrical female terminal according to claim 1, wherein the clamping member includes a wire-receiving channel member with a pair of wire-insulation clamping tabs and a pair of wire-clamping tabs projecting from the wire-receiving channel member and a neck member integrally connected to the wire-receiving channel member, the pair of wire-clamping tabs being positioned between the wire-insulation clamping tabs and the neck member, the neck member being integrally connected to the rearward end of the terminal receptacle.

3. An electrical female terminal according to claim 2, wherein the rearward end of the terminal receptacle has a bottom rearward end portion and a top rearward end portion, the bottom rearward end portion including the bottom wall and bottom side wall portions of each respective one of the pair of side walls, the top rearward end portion including the top wall and top side wall portions of each respective one of the pair of side walls, the neck member being integrally connected to the rearward end of the terminal receptacle at the bottom rearward end portion, the top rearward end portion defining a stay.

4. An electrical female terminal according to claim 3, wherein the neck member includes a pair of top neck member edges, a respective one of the top neck member edges extends substantially perpendicularly to a respective one of the pair of side walls as viewed in elevation along the central axis.

5. An electrical female terminal according to claim 1, wherein the terminal receptacle includes an insertion guide wall connected to the top wall at the forward end of the terminal receptacle and extends into the box-shaped cavity at an insertion guide wall angle towards the bottom wall and the rearward end of the terminal receptacle, the insertion guide wall being positioned forward of the spring element.

6. An electrical female terminal according to claim 1, wherein at least one of the pair of side walls includes a movement restraint window formed therethrough and the contact portion of the spring element includes at least one movement restraint tab sized to be received by the movement restraint window such that the movement restraint window permits yet restricts movement of the movement restraint tab.

7. An electrical female terminal according to claim 1, wherein one of the pair of side walls includes an orientation projection projecting therefrom.

8. An electrical female terminal according to claim 1, wherein the bottom wall includes a flat wing projection that projects laterally therefrom.

9. An electrical female terminal according to claim 1, further comprising a plateau projecting from the bottom wall internally of the box-shaped cavity, the plateau positioned generally opposite the contact portion.

10. An electrical female terminal according to claim 1, further comprising an inclined piece connected to the top wall and projecting into the cutout window at an obtuse angle relative to the top wall generally from the rearward end to the forward end.

11. An electrical female terminal, comprising:

a female terminal body extending along a central axis and including a terminal receptacle having a forward end and an opposing rearward end and a clamping member integrally connected to the terminal receptacle at the rearward end thereof, the terminal receptacle having a bottom wall, a top wall, a pair of side walls and a spring element, the top wall disposed apart from and extending parallel to the bottom wall and the pair of side walls disposed apart from and extending parallel to one another and connected to the bottom wall and the top wall to form a box-shaped configuration defining a generally box-shaped cavity extending through the terminal receptacle between a forward opening located at the forward end and a rearward opening located at the rearward end, the spring element disposed within the box-shaped cavity and connected adjacent the top wall and rearward end and projecting toward the bottom wall and the forward end, wherein the top wall includes a cutout window that is positioned offset from the central axis, wherein at least one of the pair of side walls has a spring engagement slot adjacent the top wall, and wherein the spring element is fabricated from a resiliently-bias, electrically-conductive material and includes an engagement portion, a contact portion and a straight portion integrally interconnecting the engagement portion and the contact portion, the engagement portion being in contact with the top wall inside the box-shaped cavity and extending into the spring engagement slot to retain the spring element within the box-shaped cavity, the contact portion configured in an arcuate shape to define a recess as viewed in cross-section with the recess being facially opposed to the cutout window.

12. An electrical female terminal according to claim 11, wherein at least one of the pair of side walls includes a movement restraint window formed therethrough and the contact portion of the spring element includes at least one movement restraint tab sized to be received by the movement restraint window such that the movement restraint window permits yet restricts movement of the movement restraint tab.

* * * * *